US006988586B1

(12) United States Patent
Perez

(10) Patent No.: US 6,988,586 B1
(45) Date of Patent: Jan. 24, 2006

(54) APPARATUS WITH LOCKING HINGE CONVERTIBLE BETWEEN CREEPER AND STEPLADDER CONFIGURATIONS

(76) Inventor: Genaro Perez, P.O. Box 2049, Placerville, CA (US) 95667

( * ) Notice: Subject to any disclaimer, the term of this patent is extended or adjusted under 35 U.S.C. 154(b) by 2 days.

(21) Appl. No.: 10/858,011

(22) Filed: Jun. 1, 2004

Related U.S. Application Data

(63) Continuation-in-part of application No. 10/706,020, filed on Nov. 12, 2003.

(51) Int. Cl.
*E06C 1/00* (2006.01)

(52) U.S. Cl. ..... 182/21; 280/32.6

(58) Field of Classification Search ..... 182/20, 182/21, 163; 403/94; 280/32.6
See application file for complete search history.

(56) References Cited

U.S. PATENT DOCUMENTS

| | | | | |
|---|---|---|---|---|
| 2,611,417 | A | 9/1952 | Henry et al. | |
| 3,368,847 | A * | 2/1968 | Langmead | 297/366 |
| 4,141,605 | A * | 2/1979 | Riordan et al. | 384/223 |
| 4,540,306 | A | 9/1985 | Wang | |
| 4,577,986 | A | 3/1986 | Wang | |
| 4,645,371 | A | 2/1987 | Wang | |
| 4,770,559 | A | 9/1988 | Yoo | |
| 4,889,352 | A | 12/1989 | Chamberlin, Jr. et al. | |
| 4,925,329 | A | 5/1990 | Chuang | |
| 5,022,118 | A | 6/1991 | Wan-Li | |
| 5,026,198 | A | 6/1991 | Lin | |
| 5,058,239 | A | 10/1991 | Lee | |
| 5,072,955 | A | 12/1991 | Holland et al. | |
| 5,265,969 | A * | 11/1993 | Chuang | 403/94 |
| 5,395,154 | A * | 3/1995 | Wang | 297/130 |
| 5,494,305 | A * | 2/1996 | Chen | 280/32.6 |
| 5,524,915 | A * | 6/1996 | Liu | 280/30 |
| 5,947,489 | A | 9/1999 | Tucker | |
| 6,059,298 | A | 5/2000 | Tucker | |
| 6,095,532 | A | 8/2000 | Martin | |
| 6,105,719 | A | 8/2000 | Lensing | |
| 2002/0125662 | A1 | 9/2002 | Magness | |
| 2003/0132589 | A1 * | 7/2003 | Hernandez et al. | 280/32.6 |

OTHER PUBLICATIONS

PCT Patent Application WO 00/43627 Dated: Jul. 27, 2000.

* cited by examiner

*Primary Examiner*—Alvin Chin-Shue
(74) *Attorney, Agent, or Firm*—Thomas R. Lampe

(57) ABSTRACT

Apparatus for supporting an individual is employable as either a creeper or a stepladder and includes two platform portions connected by locking hinges which selectively alternatively lock the platform portions in co-planar condition or in a configuration where the platform portions define an angle therebetween of less than 180 degrees.

3 Claims, 4 Drawing Sheets

APPARATUS WITH LOCKING HINGE CONVERTIBLE BETWEEN CREEPER AND STEPLADDER CONFIGURATIONS

This application is a continuation-in-part of my pending U.S. application Ser. No. 10/706,020, filed Nov. 12, 2003.

TECHNICAL FIELD

This invention relates to apparatus for supporting an individual and selectively alternatively employable as either a creeper or as a stepladder.

BACKGROUND OF THE INVENTION

Stepladders and creepers are well known devices. Conventionally, these devices are separate entities and are employed separately. This of course requires separate purchases. Furthermore, each device occupies its own storage space.

As will be seen below, the apparatus of the present invention incorporates platform portions hingedly interconnected to provide either a stepladder configuration or a creeper configuration. A search of the prior art located no such arrangement. There are, however, patents which show the general concept of folding creepers per se; namely, U.S. Pat. No. 6,095,532, issued Aug. 1, 2000, U.S. Pat. No. 5,947,489, issued Sep. 7, 1999, U.S. Pat. No. 6,059,298, issued May 9, 2000, U.S. Pat. No. 4,889,352, issued Dec. 26, 1989, and U.S. Pat. No. 2,611,417, issued Sep. 23, 1952.

The search also located U.S. Pat. No. 5,072,955, issued Dec. 7, 1991, relating to a mechanic's helper (not a creeper) and step platform, U.S. Pat. No. 6,105,719, issued Aug. 22, 2000, directed to a user-configurable mechanic's stool, and U.S. Patent Application Publication No. U.S. 2002/0125662, published Sep. 12, 2002. Articulated ladders enabling the ladders to fold and assume different configurations are also known, some of which utilize locking hinges generally. See the following patent publications: U.S. Pat. No. 4,925,329, issued May 15, 1990, U.S. Pat. No. 4,540,306, issued Sep. 10, 1985, U.S. Pat. No. 5,022,118, issued Jun. 11, 1991, U.S. Pat. No. 4,645,371, issued Feb. 24, 1987, U.S. Pat. No. 5,026,198, issued Jun. 25, 1991, U.S. Pat. No. 5,058,239, issued Oct. 22, 1991, U.S. Pat. No. 4,577,986, issued Mar. 25, 1986, U.S. Pat. No. 4,770,559, issued Sep. 13, 1988 and PCT Application No. WO 00/43627, published Jul. 27, 2000. However, such prior art articulated ladders are not convertible into creepers, nor is there any known prior art which incorporates the unique locking hinge structure disclosed herein in a convertible creeper/stepladder arrangement.

In summary, there is no teaching or suggestion in the prior art, whether taken alone or in combination, of the apparatus disclosed and claimed herein for supporting an individual and selectively alternatively employable as either a creeper or a stepladder.

DISCLOSURE OF INVENTION

The present invention relates to apparatus of unitary construction for supporting an individual and selectively alternatively employable as either a creeper or a stepladder. The apparatus incorporates a platform including a generally planar first platform portion and a generally planar second platform portion, each of the first and second platform portions having a top surface and a bottom surface and proximal and distal ends.

A pair of spaced locking hinges hingedly connect the proximal end of the first platform portion to the proximal end of the second platform portion. The first and second platform portions are selectively movable relative to one another about the at least one hinge to form either a creeper configuration wherein the first and second platform portions are substantially co-planar or a stepladder configuration wherein the first and second platform portions define an angle therebetween of less than 180 degrees and more than 0 degrees.

The locking hinges selectively alternatively lock the first and second platform portions against relative movement when in either said stepladder configuration or in said creeper configuration. Each locking hinge includes a first locking hinge member affixed to one of said first and second platform portions and a second locking hinge member affixed to the other of said first and second platform portions. Each locking hinge also includes a pivot element extending between and through the first and second locking hinge members.

The first and second locking hinge members are selectively pivotally movable relative to one another about the pivot element. Lock structure is employed for selectively alternatively locking the first and second locking hinge members together against pivotal movement about the pivot element when the first and second platform portions are in either the creeper configuration or the stepladder configuration.

The apparatus also includes wheels projecting downwardly from the bottom surfaces of the first and second platform portions for supporting the apparatus when the first and second platform portions are in the creeper configuration. At least one of the first and second platform portions defines foot holes for receiving the feet of an individual climbing the apparatus when the first and second platform portions are in the stepladder configuration.

Other features, advantages and objects of the present invention will become apparent with reference to the following description and accompanying drawings.

BEST MODE FOR CARRYING OUT THE INVENTION

Figures 1, 2:
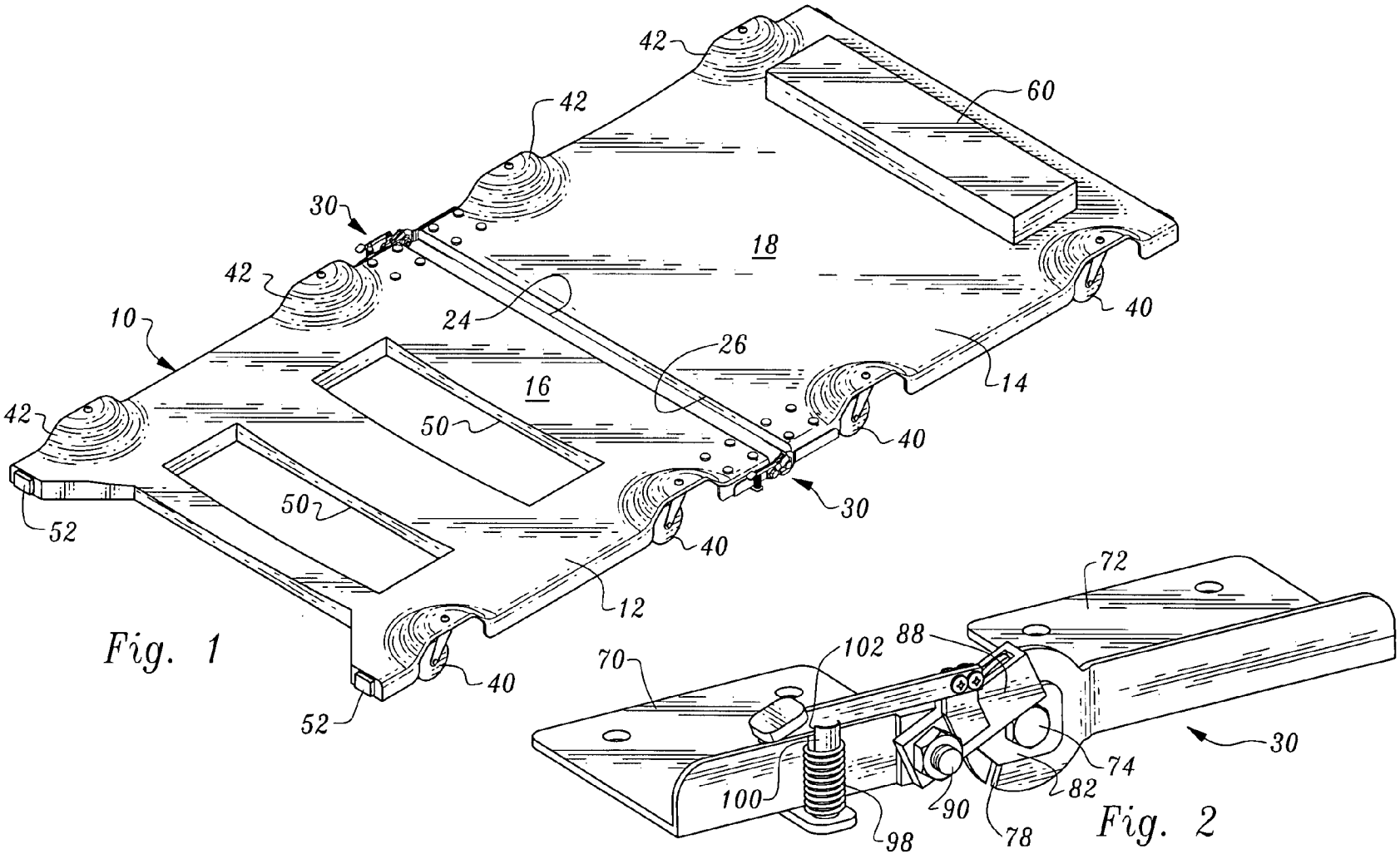
FIG. 1 is a top, perspective view of the apparatus of the present invention configured as a creeper.
FIG. 2 is a greatly enlarged, perspective view of a locking hinge of the apparatus in the position assumed thereby when the apparatus is in a creeper configuration.
Figure 4:
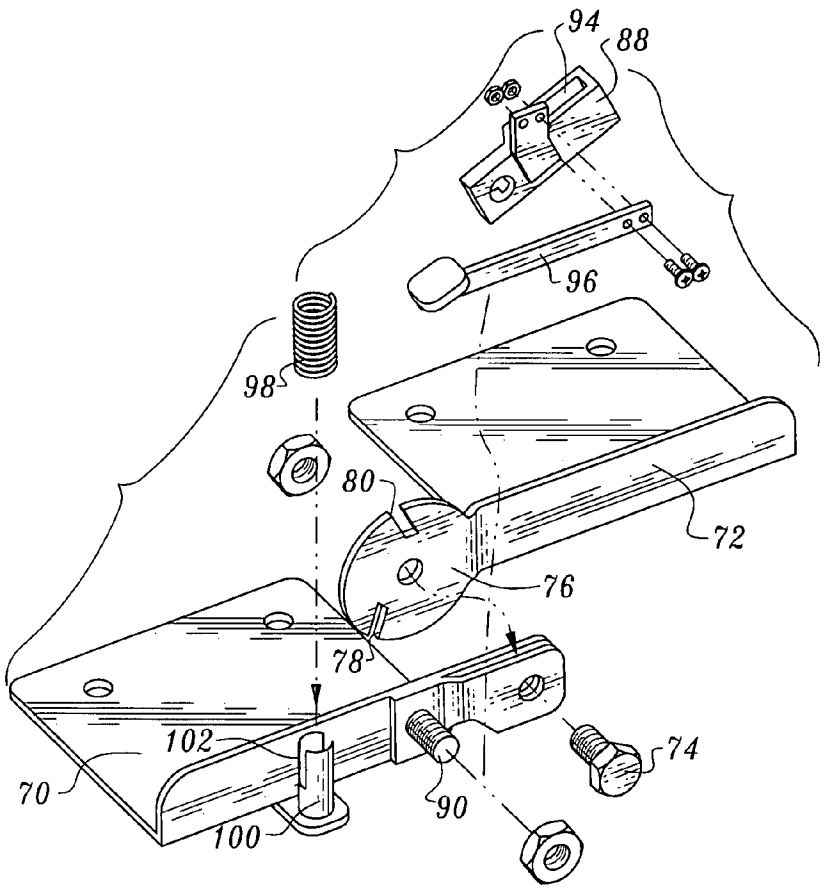
FIG. 4 is an exploded, perspective view of the locking hinge shown in FIG. 2.
Figure 3:
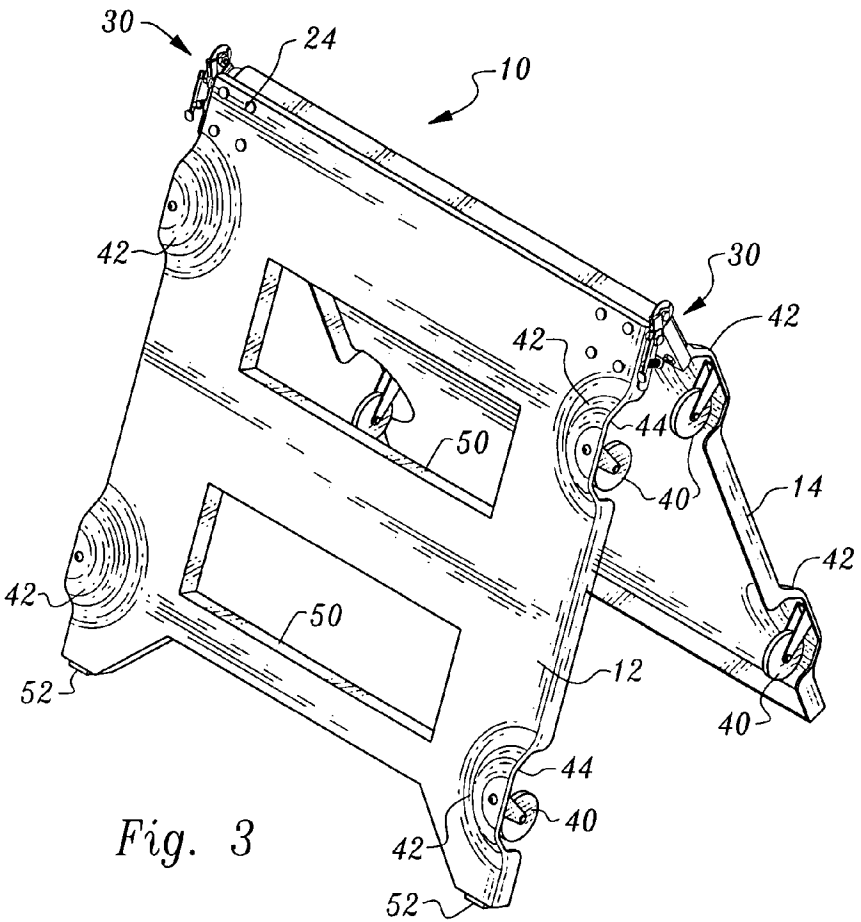
FIG. 3 is a top, perspective view of the apparatus when configured as a stepladder.
Figure 8:
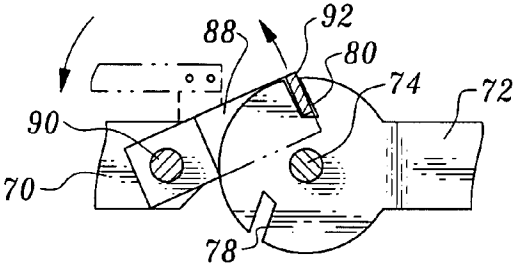
FIG. 8 is a cross-sectional view taken along line 8—8 in FIG. 5 showing components in the FIG. 6 condition.
Figure 9:
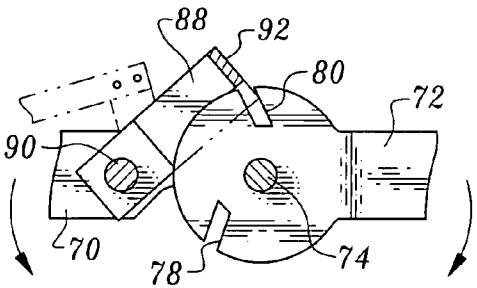
FIG. 9 is a view similar to FIG. 8, but showing components in the FIG. 7 condition.
Figure 5:
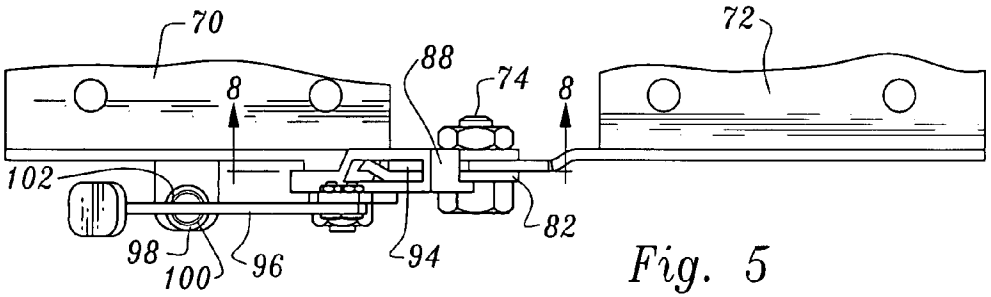
FIG. 5 is a top view of the locking hinge.
Figure 6:
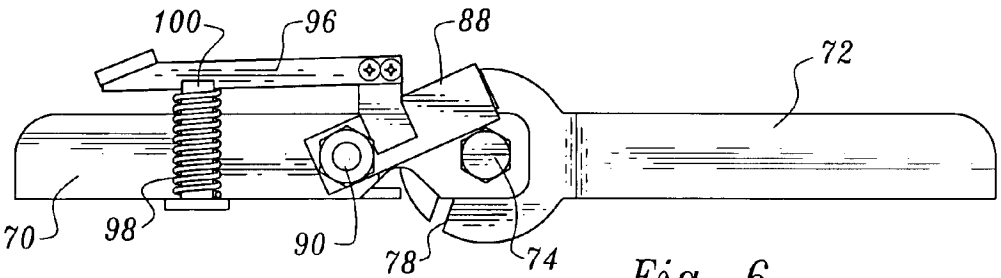
FIGS. 6 and 7 are side, elevational views of the locking hinge when the apparatus is configured as a creeper and showing lock structure thereof in two different positions.
Figure 7:
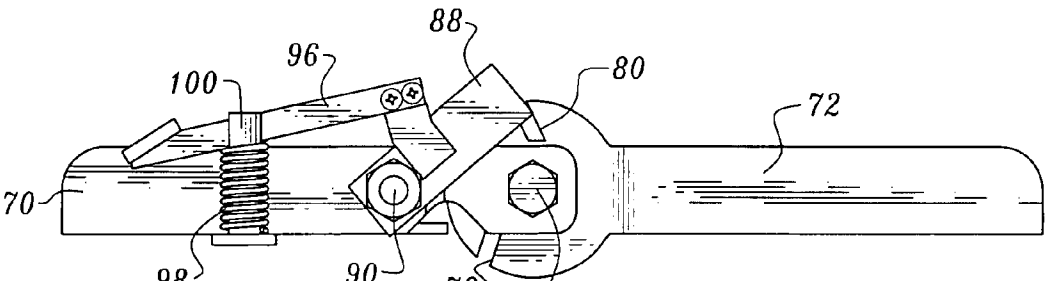

Referring now to FIGS. 1–12, apparatus constructed in accordance with the teachings of the present invention is illustrated and is for the purpose of supporting an individual and selectively alternatively employable as either a creeper (also known as a mechanic's creeper) or a stepladder.

The apparatus includes a platform 10 including a generally planar platform portion 12 and a generally planar platform portion 14. Platform portion 12 has a top surface 16 and platform potion 14 has a top surface 18. The platform portions 12, 14 also have bottom surfaces. The platform portions may be formed of any suitable material, for example molded plastic or metal. The top surfaces 16, 18 are slightly concaved or dipped to provide comfort for an individual lying on the apparatus when in its creeper configuration, as will be described in more detail below. In the arrangement shown, the concavity of top surface 16 is slightly less than the concavity of top surface 18.

The proximal ends 24, 26 of the platform portions 12, 14, respectively, are hingedly connected by locking hinges 30 of identical construction but mirror images of one another. Locking hinges 30 enable the first and second platform portions to be releasably locked against relative movement when either in a stepladder configuration or in a creeper configuration. The locking hinges 30 will be described in detail below.

The platform portions are selectively movable relative to each other about the spaced locking hinges 30 to form either a creeper configuration (shown in FIG. 1) wherein the platform portions 12, 14 are substantially co-planar or a stepladder configuration (shown in FIG. 3) wherein the platform portions define an angle therebetween of less than 180 degrees and more than 0 degrees.

Casters including caster wheels 40 project downwardly from the bottom surfaces of the platform portions for supporting the apparatus when the platform portions are in the creeper configuration. In the arrangement illustrated, there are four caster wheels 40 projecting downwardly from each platform portion to provide stability.

The platform portions 12, 14 include a plurality of upwardly projecting fenders 42 defining fender interiors accommodating portions of the caster wheels 40. The fenders further define side fender opening 44 which provide clearance for the casters to swing freely and also to provide access to the casters for replacement, repair, etc. In the arrangement illustrated, the casters are pivotally connected to the tops of the fenders by threaded connectors projecting through the fender tops.

The platform portion 12 defines elongated rectangular shaped foot holes 50 for receiving feet of an individual (not shown) climbing the apparatus when the platform portions are in the stepladder configuration.

Support surface engagement projections such as rubber pegs 52 project from the distal ends of the platform portions for engaging a floor or other support surface to support the apparatus when the platform portions are in the stepladder configuration to resist slippage of the apparatus on the support surface. A headrest 60 projects upwardly from platform portion 14 to add to the comfort of the user.

FIGS. 2 and 4–12 disclose one of the locking hinges 30. Locking hinges 30 selectively alternatively lock the first and second platform portions against relative movement when either the stepladder configuration or in the creeper configuration.

Each locking hinge includes a locking hinge member 70 affixed to platform portion 12 by suitable mechanical fasteners and locking hinge member 72 similarly attached to platform portion 14.

Figures 10, 11, 12, 13, 14:
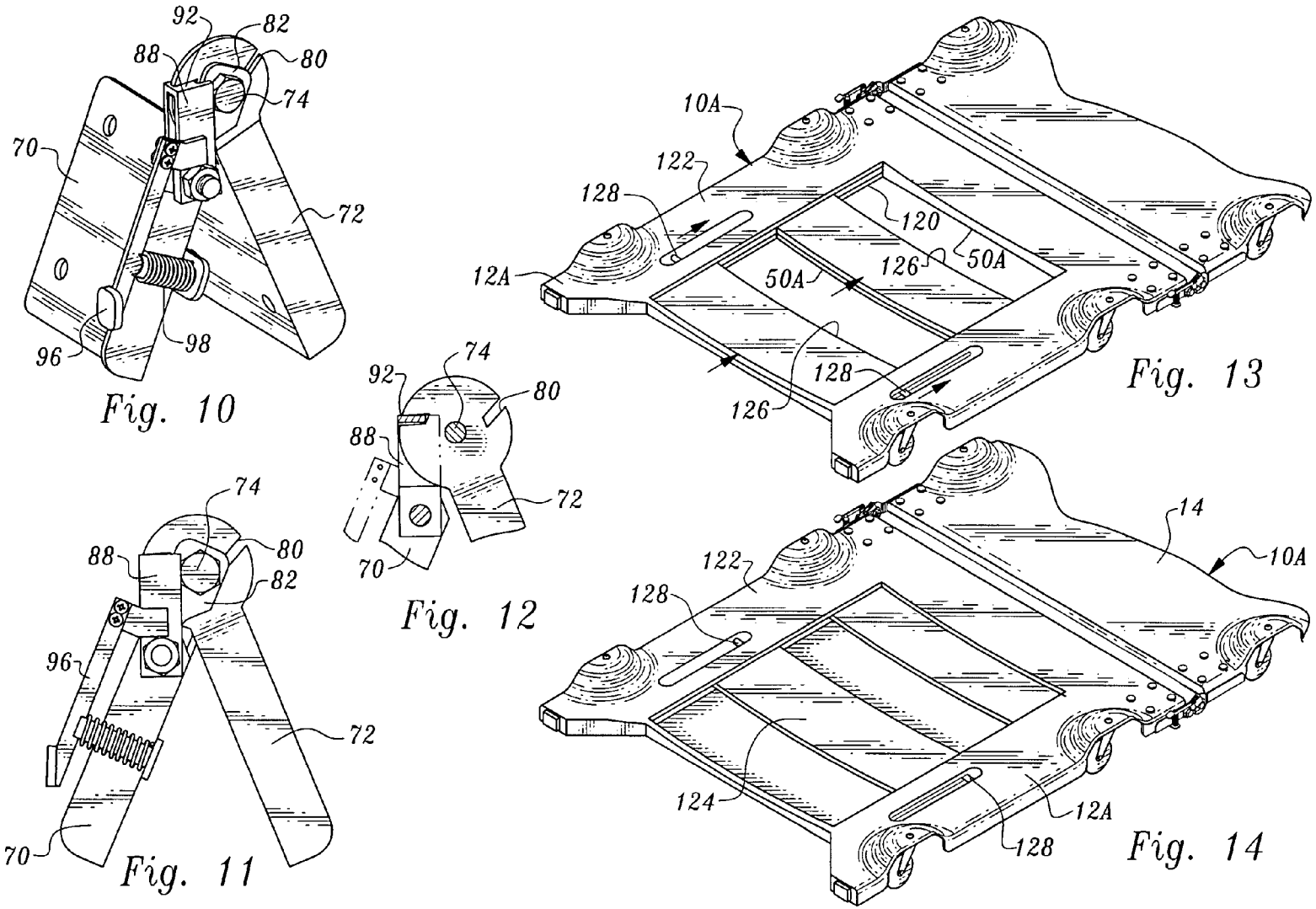
FIG. 10 is a view similar to FIG. 2, but showing the locking hinge locked in stepladder configuration.
FIG. 11 is a side, elevational view of the locking hinge in stepladder configuration.
FIG. 12 is a view similar to FIGS. 8 and 9 showing lock structure components in stepladder configuration.
FIGS. 13 and 14 are perspective views of selected portions of an alternative embodiment of the invention in alternative relative positions.

A pivot element in the form of pivot bolt 74 extends between and through locking hinge members 70, 72, being secured in place by a nut. The locking hinge members 70, 72 are selectively pivotally movable relative to one another about pivot element 74. FIGS. 2 and 5–9 show the locking hinge members 70, 72 in alignment, the configuration thereof when the apparatus is utilized as a creeper. FIGS. 10–12, on the other hand, show the locking hinge members 70, 72 angled relative to one another, the configuration thereof when the apparatus forms a stepladder.

Locking hinge member 72 includes a plate 76 having a circular-shaped outer peripheral wall and spaced, angled notches 78, 80 projecting inwardly from the outer peripheral wall.

Locking hinge member includes a projection 82 disposed side-by-side with the plate 76. Projection 82 is bifurcated, i.e. the projection includes two spaced projection portions defining a gap receiving the plate. The projection portions are disposed on opposed sides of the plate to stabilize the plate against wobbling or sideways movement.

The locking hinge member 70 also includes lock structure for selectively alternatively locking hinge members 70, 72 together against pivotal movement about the pivot element 74 when the platform portions 12, 14 are either in the creeper configuration or the stepladder configuration.

The lock structure includes a lock element 88 pivotally mounted on platform portion 12 by a stud 90 comprising a component of locking hinge member 70. A nut is threadedly secured to the distal end of stud 90. A spacer (not shown) may be employed on the stud to maintain a predetermined distance between lock element 88 and platform portion 12.

Lock element 88 has a closed distal end 92 in the form of a lock element end wall positioned at the end of a channel 94 which receives plate 76. The closed distal end or wall 92 is selectively positionable in notches 78, 80.

Biasing structure is associated with lock element 88 to bias closed distal end 92 towards the plate. More particularly, a manually engageable member 96 is affixed to lock element 88 and is utilized to pivot lock element 88 into and out of engagement with the plate 76 as desired. Once the closed distal end 92 exits the notches, pivoting of the locking hinge members is readily accomplished. Manual release of the member 96 allows entry of the closed distal end of the lock element into the notch with which it is aligned. FIGS. 6–9 and 12 provide illustrations of this activity.

The lock element 88 is continuously biased so that the closed distal end thereof is urged toward the plate. Biasing is accomplished by means of a coil compression spring 98 disposed about a hollow boss 100 having a notch 102 at the upper end thereof. The notch accommodates member 96 at all times to provide stability thereto.

FIGS. 13 and 14 show another embodiment 10A of the invention. In this embodiment platform portion 12A has a bottom 120 and a top 122 defining a recess therebetween slidably accommodating a closure plate 124. Closure plate 124 has closure plate openings 126 which conform to foot holes 50A formed in the platform portion 12A. The closure plate openings 126 communicate with foot hole openings 50A when the apparatus is employed as a stepladder (the situation in FIG. 13).

When the apparatus 10A is to be used as a creeper, handles 128 are used to slide the closure plate 124 to the position shown in FIG. 14 in which the foot holes 50A are covered by the solid portion of the closure plate. This provides a more comfortable surface for supporting a person employing the apparatus in its creeper mode.

I claim:

1. Apparatus for supporting an individual and selectively alternatively employable as either a creeper or a stepladder, said apparatus comprising, in combination:

a platform including a generally planar first platform portion and a generally planar second platform portion, each of said first and second platform portions having a top surface and a bottom surface and proximal and distal ends;

a pair of spaced locking hinges hingedly connecting the proximal end of said first platform portion to the proximal end of said second platform portion, with said first and second platform portions being selectively movable relative to each other about said locking hinges to form either a creeper configuration wherein said first and second platform portions are substantially co-planar or a stepladder configuration wherein said first and second platform portions define an angle therebetween of less than 180 degrees and more than 0 degrees and said apparatus is supported by and extends upwardly from the spaced distal ends of the angularly disposed first platform portion and second platform portion, said locking hinges selectively alternatively locking said first and second platform portions against relative movement both when the first platform portion and the second platform portion are in said stepladder configuration or in said creeper configuration, each said locking hinge including a first locking hinge member affixed to said first platform portion and a second locking hinge member affixed to said second platform portion, a pivot element extending between and through said first and second locking hinge members, said first and second locking hinge members being selectively pivotally movable relative to one another about said pivot element, and lock structure for selectively alternatively locking said first and second locking hinge members together against pivotal movement about said pivot element both when said first and second platform portions are in said creeper configuration or in said stepladder configuration; and caster wheels projecting downwardly from the bottom surfaces of said first and second platform portions for supporting said apparatus when said first and second platform portions are in said creeper configuration, and at least one of said first and second platform portions defining foot holes extending completely therethrough for receiving feet of an individual climbing the apparatus when said first and second platform portions are locked against relative movement by said locking hinges in said stepladder configuration, said first locking hinge member including a plate having an outer peripheral wall and spaced notches projecting inwardly from said outer peripheral wall and said second locking hinge member including a projection disposed side-by-side with said plate and including two spaced projection portions defining a gap receiving said plate, said projection portions being disposed on opposed sides of said plate to stabilize said plate against sideways movement, said lock structure including a lock element pivotally mounted on said second platform portion having a lock element distal end selectively alternatively positionable in said spaced notches and biasing structure biasing said distal end toward said plate, said lock element being pivotally connected to said second platform portion at a pivot location spaced from said lock element distal end and said biasing structure comprising a compression spring connected to said lock element, said compression spring and said lock element distal end located at opposed sides of said pivot location, said lock element including a manually engageable member for rotating said lock element about said pivot location against the bias exerted on said lock element by said compression spring and defining a lock element channel receiving said plate, the lock element distal end comprising a lock element end wall at an end of said lock element channel and selectively alternatively positionable in said notches, said compression spring located between said lock element distal end and said manually engageable member.

2. The apparatus according to claim 1 additionally comprising a closure plate slidably mounted on at least one of said platform portions for selectively opening or closing said foot holes.

3. The apparatus according to claim 1 including a boss extending from said second locking hinge member, said compression spring having an open end receiving said boss and said manually engageable member positioned in a recess defined by said boss to stabilize said manually engageable member against sideways movement.

* * * * *